US005345878A

United States Patent [19]

Jacob

[11] Patent Number: 5,345,878

[45] Date of Patent: Sep. 13, 1994

[54] APPARATUS AND METHOD FOR MOVING RAILWAY CARS

[76] Inventor: Charles Jacob, P.O. Box 611, American Fork, Utah 84003

[21] Appl. No.: 930,335

[22] Filed: Aug. 17, 1992

[51] Int. Cl.[5] ..... B61C 7/00

[52] U.S. Cl. ..... 105/136; 105/26.05; 105/34.1; 105/157.1

[58] Field of Search ..... 105/26.05, 26.01, 34.1, 105/34.2, 54, 55, 63, 64.1, 72.2, 85, 96, 96.2, 100, 129, 133, 136; 180/308, 65.5

[56] References Cited

U.S. PATENT DOCUMENTS

| | | | |
|---|---|---|---|
| 1,646,310 | 10/1927 | Osthoff | 105/26.1 |
| 1,911,531 | 5/1933 | Roderwald | 105/26.1 |
| 2,621,892 | 12/1952 | Kilness | 254/35 |
| 3,098,574 | 7/1963 | Marco | 180/308 |
| 3,120,741 | 2/1964 | Stewart | 60/97 |
| 3,232,240 | 2/1966 | Stewart | 105/26.1 |
| 3,653,330 | 4/1972 | Yard | 105/90 |
| 3,828,690 | 8/1974 | Stewart et al. | 105/60 |
| 4,721,430 | 1/1988 | Littke et al. | 105/96.2 |

FOREIGN PATENT DOCUMENTS

| | | | |
|---|---|---|---|
| 0940375 | 1/1974 | Canada | 105/96 |
| 0136246 | 6/1979 | Fed. Rep. of Germany | 105/96.2 |

*Primary Examiner*—Mark T. Le

*Attorney, Agent, or Firm*—Thorpe, North & Western

[57] ABSTRACT

A railcar moving device for localized moving of railcars in railyards and the like comprises two hydraulic motors which operatively attach to the railcar, each motor being attached to the end of an axle of the car. A rotatable shaft extends from each motor and is securely attached to a hub which in turn is attached to an endcap secured to the end of the axle. The rotation of the rotable shaft under the power of the motor thus rotates the axle and moves the railcar. An elongate torsion arm is secured at its ends to the motors for minimizing intrinsic movement of the motors.

4 Claims, 3 Drawing Sheets

APPARATUS AND METHOD FOR MOVING RAILWAY CARS

FIELD OF THE INVENTION

The present invention concerns apparatuses and methods for moving vehicles, and particularly railway cars.

BACKGROUND OF THE INVENTION

In railroad yards there is a need for convenient, small, and relatively cheap means for moving railway cars (or railcars) short distances without having to hook them up to a locomotive or other separate moving engine car which must push or pull the car to the desired location. This method is cumbersome and hard to use in confined or limited spaces. This need also exists outside of railroad yards where railway cars are used in connection with track construction, maintenance, or other tasks which require the moving of cars short distances and often in opposite directions. For example, a railway car is useful for holding and transporting new railroad ties when the old ties are replaced, and for holding and transporting the old ties when they are removed. In such an application, the railcar must repeatedly be moved short distances to stay near where the ties are being replaced. Obviously, a locomotive or similar device would be unsuitable for such use since it would take up an inordinate amount of space and would be inefficient and expensive. The railcar could be moved by hand, but this is difficult and expensive in terms of manpower required.

Various devices intended for use in conveniently moving railway cars limited distances have been proposed in the prior art. These include powered devices having rollers that are placed under a railway car wheel on the track, the rollers being powered to move the wheel and thus the car; the rollers sometimes are placed only on the periphery of the wheel to move it. Examples of these devices are disclosed in Stewart et al., U.S. Pat. No. 3,828,690, Stewart, U.S. Pat. No. 3,232,240, Stewart, U.S. Pat. No. 3,120,741, and Osthoff, U.S. Pat. No. 1,646,310. Though the disclosed devices are an improvement over moving the cars by locomotive or by hand, they are rather complicated, require a considerable expenditure of energy, and rely on friction between the device and the wheel or track, the lack of which may be a problem.

Other prior art devices include Yard, U.S. Pat. No. 3,653,330, and Kilness, U.S. Pat. No. 2,621,892, which attach to the wheel periphery and track and which are operated by hand. Other references include Roderwald, U.S. Pat. No. 1,911,531, which discloses an apparatus for converting the power of the moving train car axle into electrical power, by use of a dynamo, for lighting the train.

There remains a need for a device which is easy to install and remove, is relatively small and inexpensive, and which does not depend on exact placement between the wheel and the track or on the track for proper operation.

OBJECTS AND SUMMARY OF THE INVENTION

It is therefore an object of the present invention to provide a railway car moving device and method which is relatively small, easy to operate, and convenient for use and transport.

It is a further object of the invention to provide such a device and method that does not depend on placement on the outer edge of a railway car wheel or track for use.

It is a further object of the invention to provide such a device and method that is conveniently and reliably stabilized and in which intrinsic movement is minimized.

In accordance with a first aspect of the invention, an apparatus for driving a railroad car, the car including first and second wheels, an elongate axle operatively connected to the wheels, the axle having first and second ends, first and second bearing housings journalled on the axle near the first and second ends thereof, respectively, first and second trucks overlying the first and second bearing housings, respectively, and a bed supported by the trucks, comprises a motor adapted for direct mounting on the first end of the axle for rotating the axle and mounting means for mounting the motor on the first end of the axle.

In accordance with a second aspect of the invention, an elongate torsion arm is affixed at one end to the motor of the first aspect and at a second end to a secure attachment to minimize intrinsic movement of the motor.

In accordance with a third aspect of the invention, a method of moving a railroad car comprises the steps of coaxially attaching a rotatable shaft to an end of an axle of the car and rotating the shaft.

Specifically, and in a preferred embodiment, an apparatus for moving a railcar including a bed, first and second side trucks disposed beneath and supporting the bed, first and second elongate axles, each having first and second ends, journalled near their ends in the trucks, and four wheels, each disposed near an end of an axle, comprises first and second end caps secured to the first ends of the first and second elongate axles, respectively, first and second hubs secured to the first and second end caps, respectively, first and second rotatable shafts secured to the first and second hubs, respectively, first and second hydraulic motors operatively attached to the first and second rotatable shafts, respectively, such that the shafts are rotated under the power of the motors, thereby rotating the hubs, end caps, axles, and wheels, and a rigid elongate torsion arm, having first and second ends, whose first end is secured to the first motor and whose second end is secured to the second motor to stabilize movement of the motors.

BRIEF DESCRIPTION OF THE DRAWINGS

These and other objects, aspects, and embodiments will be described with reference to the following drawing figures, of which.

DETAILED DESCRIPTION OF THE INVENTION

Figure 1:
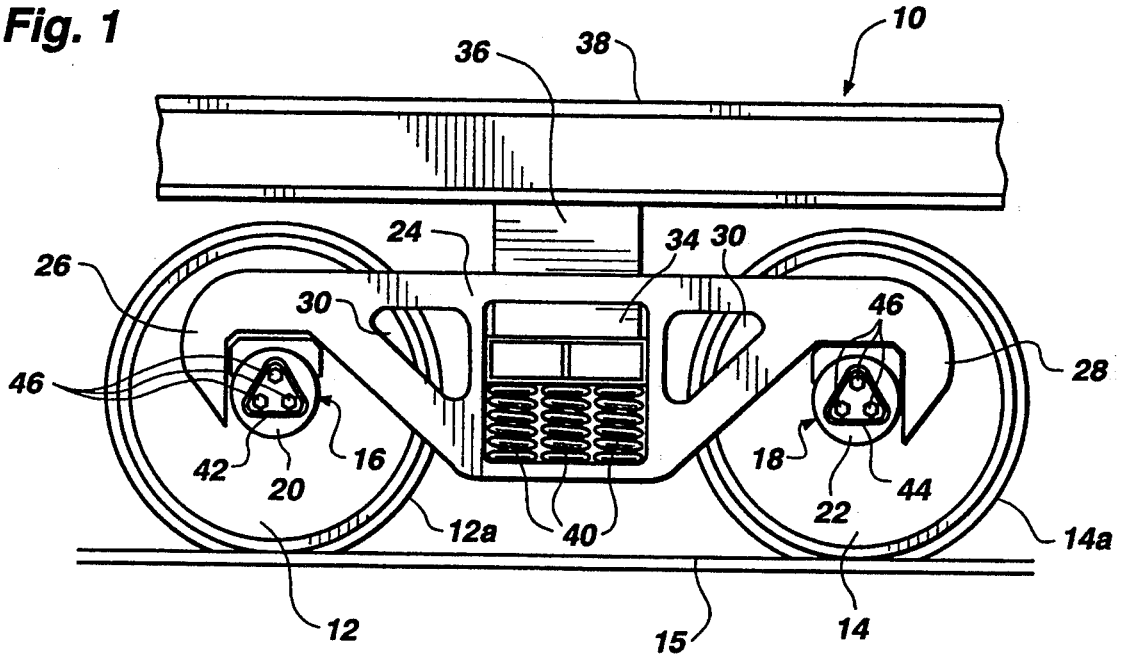
FIG. 1 is a side elevational view of a typical flatbed railway car wheel and truck assembly.
Figure 2:
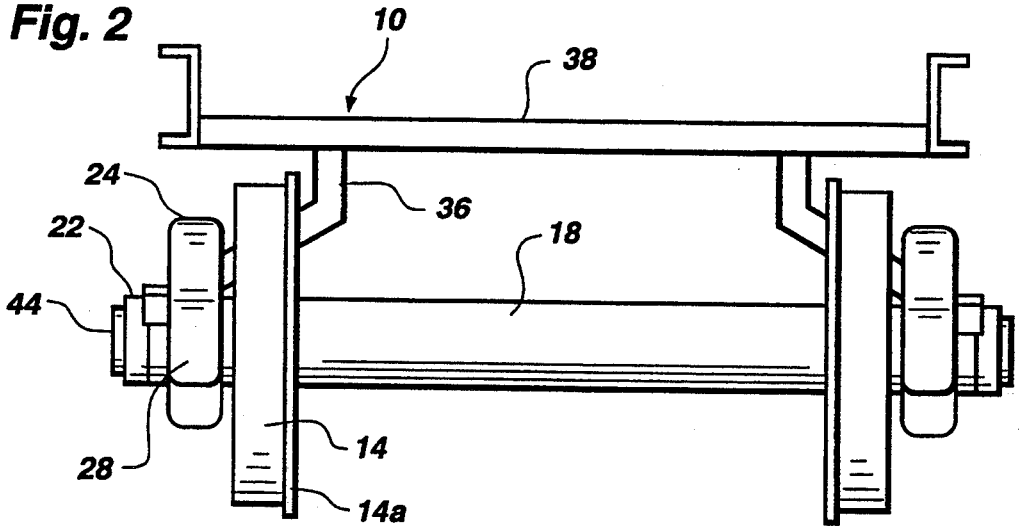
FIG. 2 is a rear elevational view of the railcar wheel and truck assembly of FIG. 1.

Referring first to FIGS. 1 and 2, a conventional railcar wheel and truck assembly 10 on one side of a railcar comprises front and rear wheels 12 and 14, each of which comprise a flat cylinder oriented edgewise with a flange 12*a* or 14*a* extending from one side of the cylinder. The flat cylinders and flanges are shaped such that the wheels 12 and 14 fit smoothly onto the railroad track 15. Most prior art railcar moving devices comprise powered rollers or the like which attach to cylinder or the flange of the wheel in order to move the wheel.

Axles 16 and 18 are disposed through the wheels 12 and 14, respectively, for rotation of the wheels, and front and rear bearing housings 20 and 22 are journalled onto the axles 16 and 18 near the ends thereof. A conventional truck 24, extending between the wheels 20 and 22, is mounted on the bearing housings 20 and 22. The truck 24 includes mounting forks 26 and 28 by which the truck 24 is mounted on the bearing housings 20 and 22, respectively. The truck 24 also contains front and rear holes 30 cut into the body of the truck to save on weight and material. A larger middle hole 34 is also cut into the body of the truck 24. A beam 36, rigidly attached to the bed 38 of the flatcar, extends into the middle hole 34, and is supported therein by springs 40. The bed of the flatcar is attached to the truck and wheel assembly 10 through the beam 36 and springs 40, by which some shock absorption is provided.

Front and rear end caps 42 and 44 are attached to the ends of the axles 16 and 18, respectively, and cover the ends of the axles as well as the bearing housings 20 and 22. Each end cap is attached to the axle by three bolts 46 arranged in a triangular pattern, the bolts running through the end cap into the axle.

Figure 3:
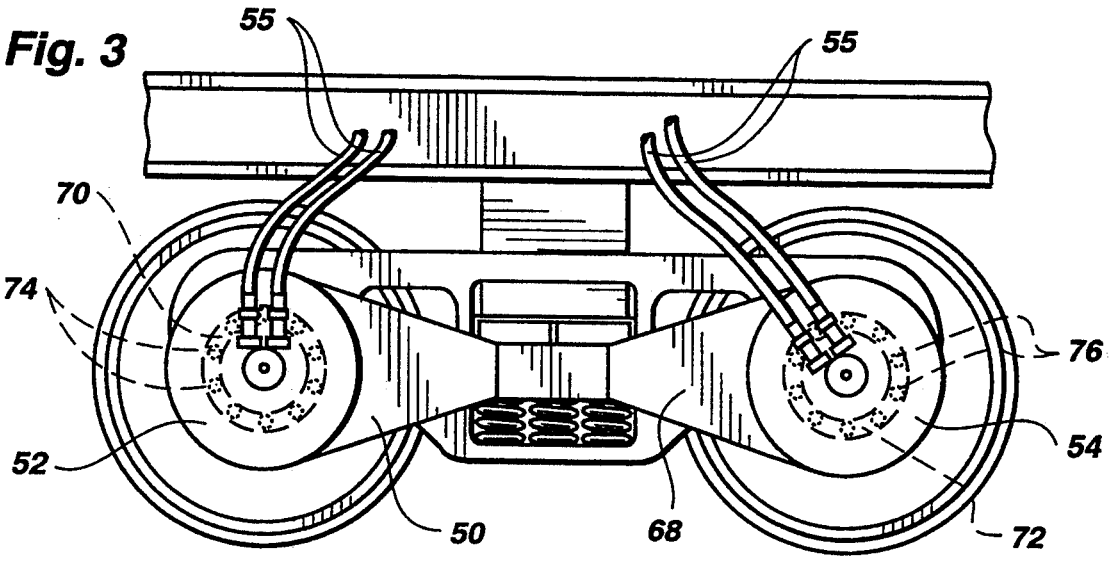
FIG. 3 is a side elevational view of an example of a railcar moving apparatus according to the invention installed on the railcar of FIG. 1.
Figure 4:
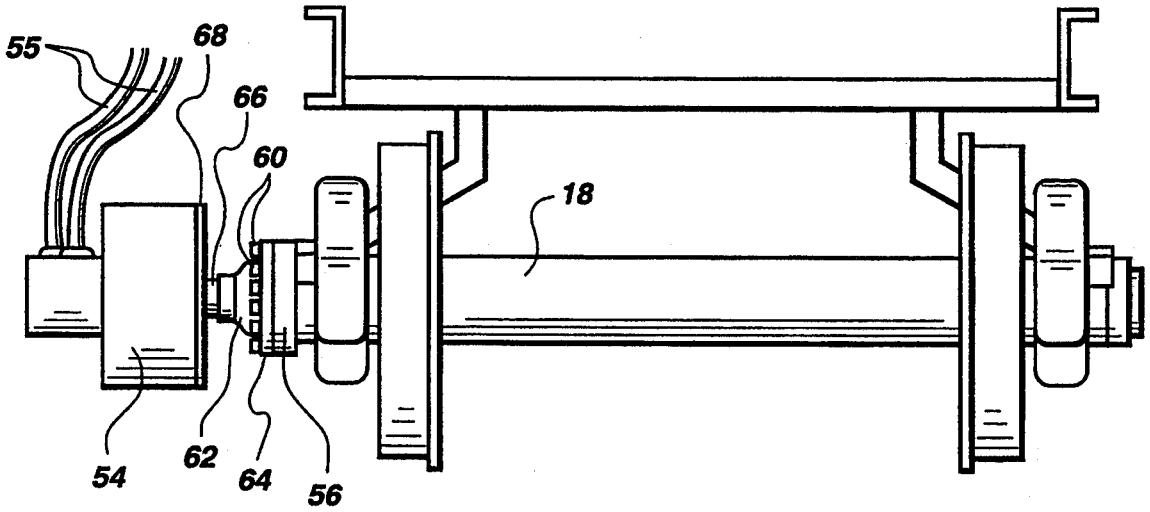
FIG. 4 is a rear elevational view of the moving apparatus of FIG. 3 installed on the railcar of FIG. 1.

Referring now to FIGS. 3 and 4, a railcar moving device 50 according to the invention comprises two hydraulic motors 52 and 54 which are adapted for attachment to the ends of the front and rear axles 16 and 18 of the wheel/truck assembly 10 for rotation of the axles and thus the wheels. Since the motors are attached directly to the axles, there is no need, as in prior art devices, for fitting of the device on the wheel or alignment of the device with the track, nor is there any problem of wear of powered rollers pressed against the wheel and/or track, and, since the present invention does not rely on friction for its performance, there is little energy loss and efficiency is maximized.

Hydraulic motors are used in the preferred embodiment of the invention, since they can be easily powered from pumps (not shown) remote to the motors through hydraulic tubing 55. However, other power sources, such as gearing from an engine to the axle ends, are also contemplated and within the scope of the invention. Other power sources which might be connected to the axle ends include electric motors.

Though it is preferable to use two motors 52 and 54, one on the end of each axle 16 and 18, the invention can work very well with just one motor installed on one axle, if desired. If more power is needed, two additional motors can be installed on the opposite ends of the axles 16 and 18, making a total of four motors, one on each end of each axle.

Each motor 52, 54 is installed on the end of the axle in a similar way. In the preferred embodiment, installment of, e.g., the motor 54, begins with the removal of the end cap 44 from the end of the axle 18, exposing the end of the axle and the bearing housing 22. A modified end cap 56 is then placed onto the end of the axle 18, preferably using the same or similar bolts 46. The modified end cap 56 is of cylindrical shape, and differs principally from the end cap 44 in that the former is of a greater diameter and has apertures for receiving a plurality of bolts 60 around its periphery.

A hub 62 of generally frustoconical shape is rigidly mounted on the modified end cap 56 by means of a flange 64 extending from the base of the hub 62. The bolts 60 run through the flange 64 into the modified end cap 56, securing the hub thereto. The hub 62 in turn is secured by welding or other suitable means to a rotatable shaft 66 extending from the motor 54, the former being rotated under the power of the latter.

By means of the securing arrangement of the axle 18, the modified end cap 56, the hub 62, and the shaft 66, the motor 54 rotates the shaft 66 and thus the axle 18, turning the wheel 14 and thus moving the railcar along the track. The motor 52 operates similarly and assists the motor 54 in the movement.

An elongate flat torsion arm 68 having front and rear open looped ends 70 and 72 is attached to the hydraulic motors 52 and 54. The looped end 70 is bolted by means of bolts 74 or otherwise secured to the motor 52, and the looped end 72 is bolted by means of bolts 76 or otherwise secured to the motor 54. The torsion arm 68 acts to stabilize the motors 52 and 54 and minimize intrinsic movement of the same which might result from the rotation of the shafts.

Figure 5:
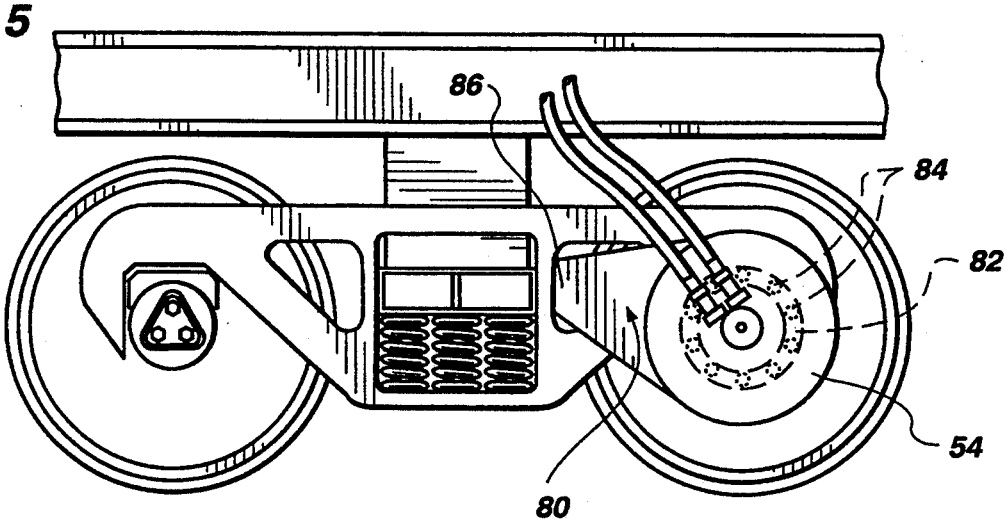
FIG. 5 is a side elevational view of another example of a railcar moving apparatus according to the invention installed on the railcar of FIG. 1.

Referring now to FIG. 5, another example of a torsion arm 80 is shown which may be used if only one motor, e.g., the motor 54, is used or if the torsion arm 68 is unsuitable in a particular application. The torsion arm 80 has one looped end 82 which attaches to the motor 54 by bolts 84 or other means, while its other end 86 is adapted for insertion into the hole 32 in the truck 24 or another hole in the truck. The insertion of the end 86 of the torsion arm 80 into the hole 32 stabilizes the motor 54 against intrinsic movement which may occur from shaft rotation. The end 86 of the torsion arm 80 can be secured solely by insertion into the hole 32 but can be further secured by bolts or other means.

Figure 6:
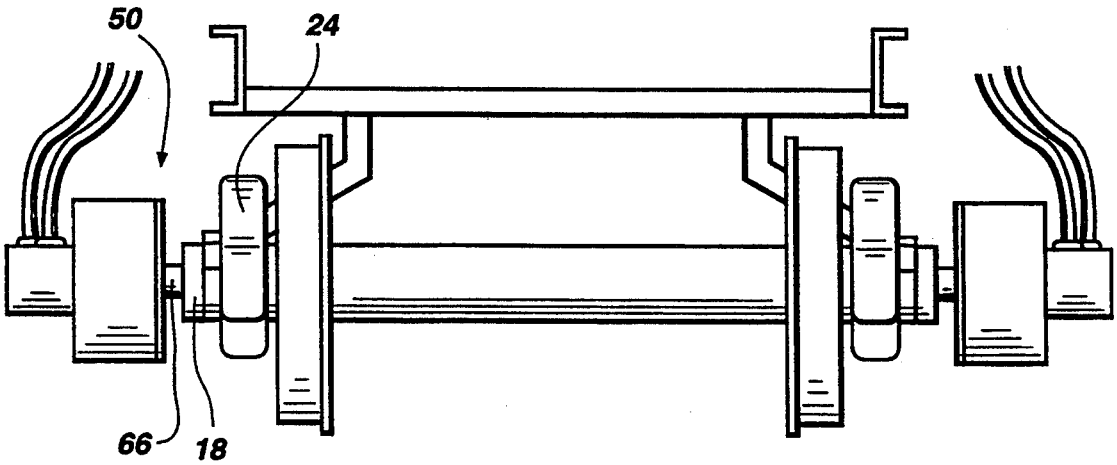
FIG. 6 is a rear elevational view of another example of a moving apparatus according to the invention installed on the railcar of FIG. 1.

Referring now to FIG. 6, another embodiment of the invention is shown in which the hub 62 and modified end cap 56 are dispensed with because, in this embodiment, the rotatable shaft 66 attaches directly to the end of the axle 18. The attachment can be carried out by welding or bolting or other suitable means. This embodiment has the advantage of bringing the moving device 50 closer to the truck 24, but cannot be installed or removed as easily as the embodiment of FIGS. 3 and 4.

Figure 7:
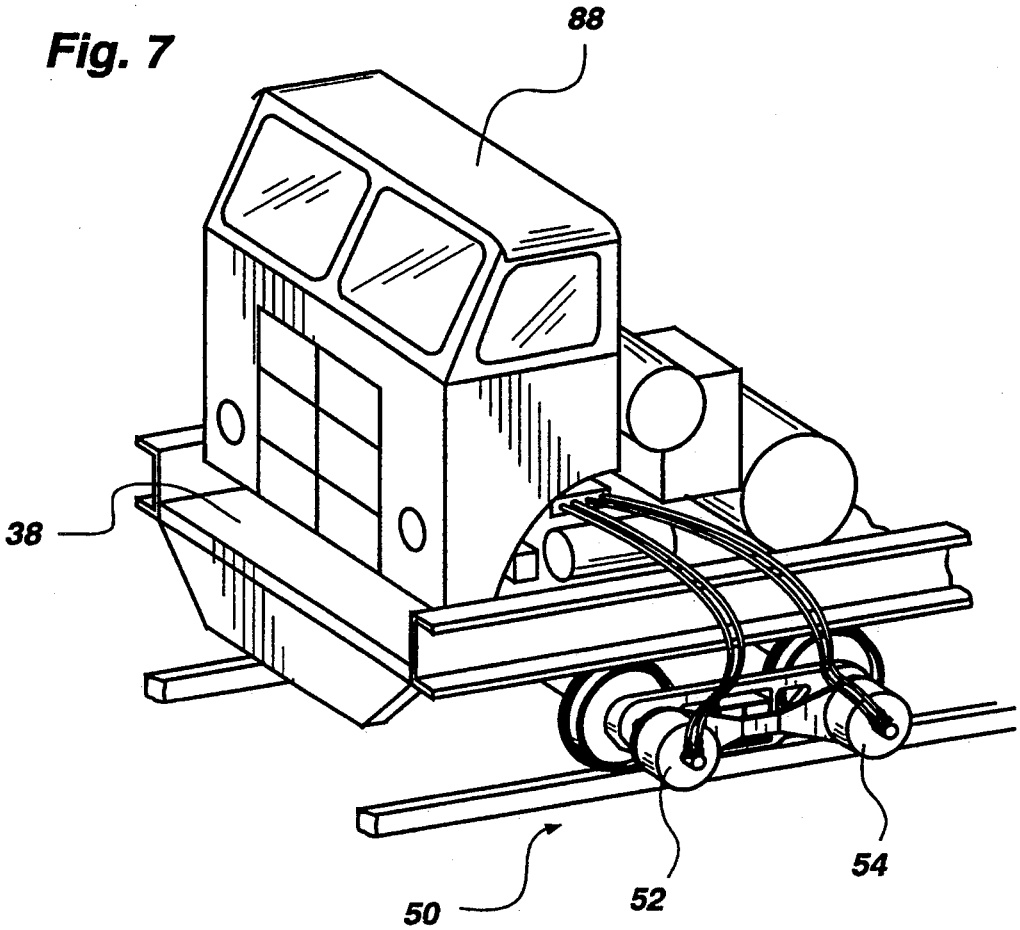
FIG. 7 is a perspective view of the moving apparatus of FIG. 3 showing the power source for the apparatus.

Referring now to FIG. 7, the moving device 50 is shown together with an example of a power source for powering the hydraulic motors 52 and 54. The power source comprises the diesel engine and cab 88 of a tractor-trailer road rig which has been modified in a conventional manner to drive the motors 52, 54. The engine 88 is secured to the bed 38 of the railcar. A power source of this type is advantageous in that it can be readily adapted for the contemplated use and in that the operator can use the existing controls in the cab to operate the moving device 50. Nevertheless, this is only one apparatus out of many that can be used to power the device.

The foregoing disclosure describes a few embodiments of the invention solely as examples. Those skilled in the art will appreciate that modifications and variations to the described embodiments are possible while still remaining within the scope of the invention.

What is claimed is:

1. Apparatus for driving a railroad car, the car including first and second wheels, an elongate axle operatively connected to the wheels, the axle having first and second ends, first and second bearing housings journalled on the axle near the first and second ends thereof, respectively, first and second trucks overlying the first and second bearing housings, respectively, and a bed supported by the trucks, comprising:

a motor adapted for direct mounting on the first end of the axle for rotating the axle said motor including a rotatable shaft and means for rotating the shaft;

mounting means for mounting the motor on the first end of the axle, said mounting means comprising a modified end cad fastened to the end of the axle and hub fastened to the end cap, the hub being attached to the rotatable shaft whereby the rotation of the shaft rotates the hub, end cap, and axle.

2. The apparatus of claim 1 wherein the modified end cap is fastened to the end of the axle by three bolts running through the end cap into the axle, the three bolts being arranged in a triangular pattern, and wherein the hub is fastened to the end cap by a plurality of bolts running through the periphery of the hub into the periphery of the end cap.

3. Apparatus for driving a railroad car, the car including first and second wheels, an elongate axle operatively connected to the wheels, the axle having first and second ends, first and second bearing housings journalled on the axle near the first and second ends thereof respectively, first and second trucks overlying the first and second bearing housings, respectively, and a bed supported by the trucks, comprising:

a motor adapted for direct mounting on the first end of the axle for rotating the axle;

mounting means for mounting the motor on the first end of the axle;

third and fourth wheels;

a second elongate axle having first and second ends operatively connecting the third and fourth wheels;

third and fourth bearing housings journalled on the second axle near the first and second ends thereof, respectively, the first and second trucks overlying the third and fourth bearing housings, respectively, a second motor adapted for direct mounting on the first end of the second axle for rotating the second axle;

means for mounting the second motor on the first end of the second axle; and a rigid elongate torsion arm having first and second ends, the first end being fixedly attached to the first motor and the second end being fixedly attached to the second motor.

4. Apparatus for moving a railcar including a bed, first and second side trucks disposed beneath and supporting the bed, first and second elongate axles, each having first and second ends, journalled near their ends in the trucks, and four wheels, each disposed near an end of an axle, comprising:

first and second end caps secured to the first ends of the first and second elongate axles, respectively;

first and second hubs secured to the first and second end caps, respectively;

first and second rotatable shafts secured to the first and second hubs, respectively;

first and second hydraulic motors operatively attached to the first and second rotatable shafts, respectively, such that the shafts are rotated under the power of the motors, thereby rotating the hubs, end caps, axles, and wheels;

a rigid elongate torsion arm, having first and second ends, whose first end is secured to the first motor and whose second end is secured to the second motor to stabilize movement of the motors.

* * * * *